United States Patent [19]

Germann

[11] Patent Number: 5,007,339

[45] Date of Patent: Apr. 16, 1991

[54] CONVERTIBLE MULTI-COLOR PRINTING MACHINE, ESPECIALLY FOR THE PRINTING OF BANKNOTES

[75] Inventor: Albrecht J. Germann, Wurzburg, Fed. Rep. of Germany

[73] Assignee: De La Rue Giori S.A., Lausanne, Switzerland

[21] Appl. No.: 347,503

[22] Filed: May 4, 1989

[30] Foreign Application Priority Data

May 18, 1988 [CH] Switzerland ..... 1888/88

[51] Int. Cl.[5] ..... B41F 5/16; B41F 5/22; B41L 15/10

[52] U.S. Cl. ..... 101/177; 101/179; 101/182

[58] Field of Search ..... 101/177, 175, 176, 178, 101/179–185, 220, 221, 225

[56] References Cited

U.S. PATENT DOCUMENTS 4,640,189 2/1987 Hernandez ..... 101/177
4,651,644 3/1987 Kaempfe et al. ..... 101/425

FOREIGN PATENT DOCUMENTS 92887 11/1983 European Pat. Off. ..... 101/177

*Primary Examiner*—J. Reed Fisher

*Attorney, Agent, or Firm*—Kane, Dalsimer, Sullivan, Kurucz, Levy, Eisele and Richard

[57] ABSTRACT

The printing machine has two multi-color printing units (I, II) of essentially identical construction, each composed of a first blanket cylinder (4, 14), of a second blanket cylinder (7, 17), of a plate cylinder (5, 15) and of an image transfer cylinder (6, 16). In the offset-printing position, the second blanket cylinder (7, 17) inked by offset plate cylinders (8) rests against the first blanket cylinder (4, 14), while in the collect-printing position it is moved away from this and inked by color selector cylinders. In the collect-printing position, the plate cylinder (5, 15) carries a collect-printing plate, of which the image inked by the first cylinder (7, 17) is transferred to the first blanket cylinder (4, 14) via the image transfer cylinder (6, 16). In the offset-printing position, the plate cylinder is inoperative. Furthermore, in the two printing positions, the image transfer cylinder (6, 16) interacts with the plate cylinder (10, 20) of an additional single-color printing unit, the image of which is likewise transferred to the first blanket cylinder (4, 14). The paper runs between the first blanket cylinders (4, 14), pressed against one another, of the two printing units and receives a simultaneous recto-verso print. The plate cylinder can also rest against the first blanket cylinder and in the offset-printing position, with the image transfer cylinder moved away, belong to the additional single-color printing unit.

10 Claims, 4 Drawing Sheets

CONVERTIBLE MULTI-COLOR PRINTING MACHINE, ESPECIALLY FOR THE PRINTING OF BANKNOTES

FIELD OF THE INVENTION

The invention relates to a convertible multi-color printing machine, especially for the printing of banknotes, according to the pre-characterizing clause of Patent claim 1 or according to the pre-characterizing clause of Patent claim 2.

PRIOR ART

A printing machine of this type is known from EP-A-0,132,859 of the same applicant. This is a recto-verso printing machine which consists of two convertible multi-color printing units of essentially identical construction and in which both sides of the paper are printed simultaneously in the nip between the two first blanket cylinders of the two multi-color printing units. Each of the two multi-color printing units can work either according to the offset-printing process, providing an image with superposed colors, or according to the collect-printing process supplying an image with colors lying next to one another. The collect-printing process is often also called the "Orlof" process and works with a typographic printing plate which has the complete printing design and which is inked by several color selector cylinders, also called stencil cylinders, via a blanket cylinder called a color-collect cylinder. Moreover, at least one of the two multi-color printing units of this known convertible recto-verso printing machine can be equipped with an additional single-color printing unit, especially a wet offset-printing unit, the plate cylinder of which is in contact with the first blanket cylinder of the respective multi-color printing unit and transfers onto this an additional single-color image or single-color design printed onto the respective side of the paper together with the multi-color offset or multi-color collect printing image. At the same time, the arrangement is such that, in each multi-color printing unit, the image transfer cylinder and the plate cylinder, which carries the collect-printing plate in the collect-printing position, are located underneath the first and second blanket cylinders, whilst the additional single-color printing unit is arranged above the first blanket cylinder.

SUMMARY OF THE INVENTION

The object on which the invention is based is to extend the possibilities of variation in combined printing, which can be afforded by a convertible multi-color printing machine of the type described in the pre-characterizing clause of claim 1 or 2, by simple means which can be installed in a space-saving and easily accessible way.

According to the invention, this object is achieved by means of the features indicated in the characterizing clause of claim 1 or by means of those indicated in the characterizing clause of claim 2.

The advantages arising as a result of the printing machine according to the invention are that either the image transfer cylinder which is necessary for collect printing and which can be especially a blanket cylinder is used, when the printing machine is operating both according to the collect-printing process and according to the offset-printing process, to perform an additional printing function, namely of transferring the additional image or design from the additional single-color printing unit onto the first blanket cylinder of the respective multi-color printing unit, or, when the printing machine is operating in the offset-printing mode, the plate cylinder carrying the collect-printing plate in the collect-printing process is used directly as a plate cylinder of the additional single-color printing unit. In both cases, there is no need for the necessary space which the plate cylinder of the additional single-color printing unit would occupy along the circumference of the first blanket cylinder of each convertible multi-color printing unit. Where the embodiment according to claim 2 is concerned, in the offset-printing mode a plate cylinder, namely that of the additional printing unit, is also saved, because this function is assumed by the plate cylinder carrying the collect-printing plate in the collect-printing mode.

In a particular embodiment, the multi-color printing machine according to the invention is designed as a recto-verso printing machine according to claim 3 and consists of two essentially identically constructed multi-color printing units according to claim 1 or according to claim 2 and thus allows either multi-color offset printing on both sides of the paper or multi-color collect printing on both sides of the paper or else multi-color offset printing on one side of the paper and multi-color collect printing on the other side of the paper, in each instance an additional single-color print also being produced on at least one side, preferably by means of a single-color wet offset-printing unit. Where banknotes are concerned, the multi-color offset print or the multi-color collect print preferably forms the safety background, whilst the additional single-color print provides a main design which, furthermore, can also be provided with the design of an additional safety background completing and superposed on the multi-color safety background.

Expedient forms of the invention emerge from the dependent claims. The invention is explained in detail with reference to the drawings by means of two exemplary embodiments of a sheet-fed printing machine for simultaneous recto-verso printing. In the drawings:

DESCRIPTION OF THE PREFERRED EMBODIMENTS

Figure 1:
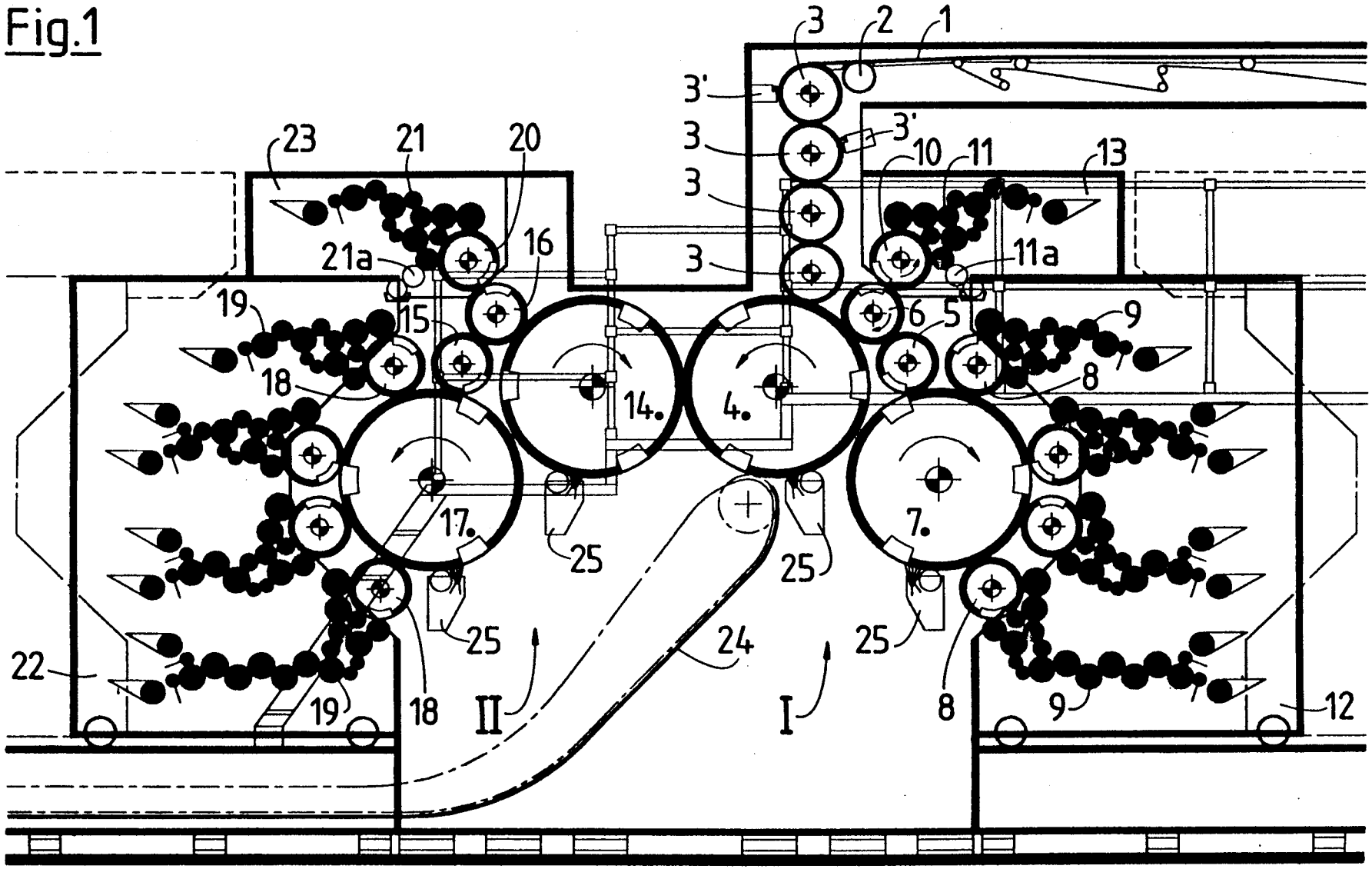
FIG. 1 shows a first embodiment of the printing machine according to the invention, in which the two multi-color printing unit are in the collect-printing position.

The printing machine consists of two convertible multi-color printing units I and II of essentially identical construction. Each printing unit has a first blanket cylinder 4, 14, a plate cylinder 5, 15, an image transfer cylinder 6, 16 and a second blanket cylinder 7, 17. The second blanket cylinder 7, 17 is inked by convertible cylinders 8, 18 which for offset printing are offset plate cylinders and for collect printing are color selector cylinders and which are each inked with a different color by their own inking unit 9, 19. All the inking units 9 are installed in an inking-unit trolley 12 and all the inking units 19 are installed in an inking-unit trolley 22.

The two impression cylinders 4 and 14 of the two printing units interact and between them form the nip. The paper 1 in sheet form is fed via a stop drum 2 and transfer drums 3 equipped with grippers, passes paper dust removal and anti-static devices 3' arranged on both sides, is received by a blanket cylinder 4, on which it is held by means of grippers, runs through the nip between the blanket cylinders 4 and 14, the two sides of the paper being printed simultaneously, and is then guided out of the machine by means of a chain-gripper system 24.

Figure 2:
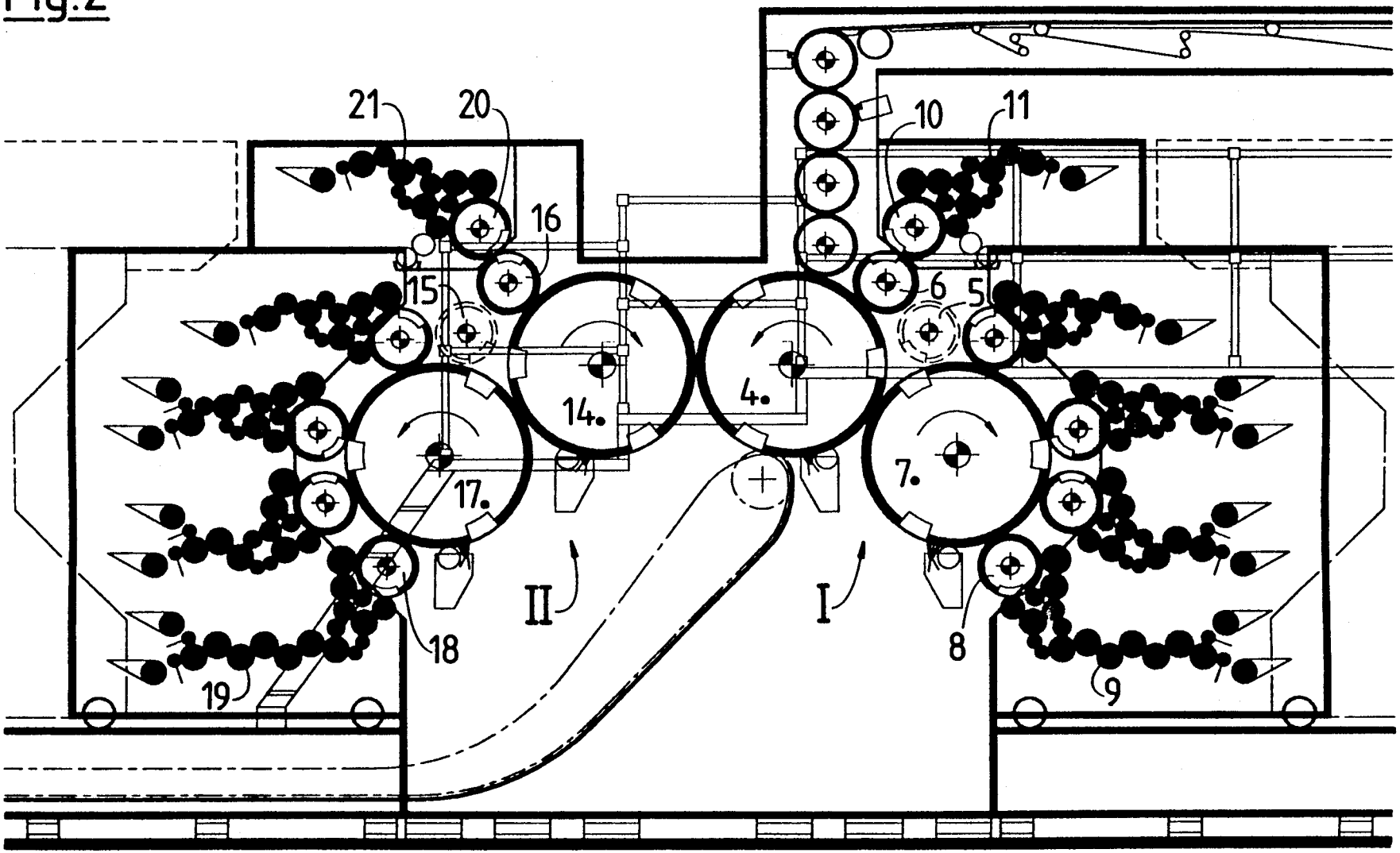
FIG. 2 shows the same machine with the two multi-color color printing units in the offset-printing position.

In the example according to FIGS. 1 and 2, the plate cylinder 5, 15 interacts with the second blanket cylinder 7, 17, and the image transfer cylinder 6, 16, which is a blanket cylinder, rests against the first blanket cylinder 4, 14. Furthermore, in the example according to FIGS. 1 and 2, the multi-color printing unit I has an additional single-color printing unit, the plate cylinder 10 of which rests against the image transfer cylinder 6 and is inked by its own inking unit 11. This additional single-color printing unit is an offset-printing unit and, as shown in FIGS. 1 and 2, preferably a wet offset-printing unit which works with a dampening unit 11*a* and, as a wet offset-printing plate, with an intaglio printing plate which is arranged on the plate cylinder and the non-printing surface of which is made ink-repellent as a result of the dampening. The inking unit 11 and the dampening unit 11*a* are accommodated in an inking-unit frame 13 which is arranged on the top of the inking-unit trolley 12.

The multi-color printing unit II has an additional single-color printing unit of identical construction with a plate cylinder 20 resting against the image transfer cylinder 16, with an inking unit 21, with a dampening unit 21*a* and with an inking-unit frame 23. It is possible, of course, to equip only one of the multi-color printing units I or II with an additional single-color printing unit.

Figure 3:
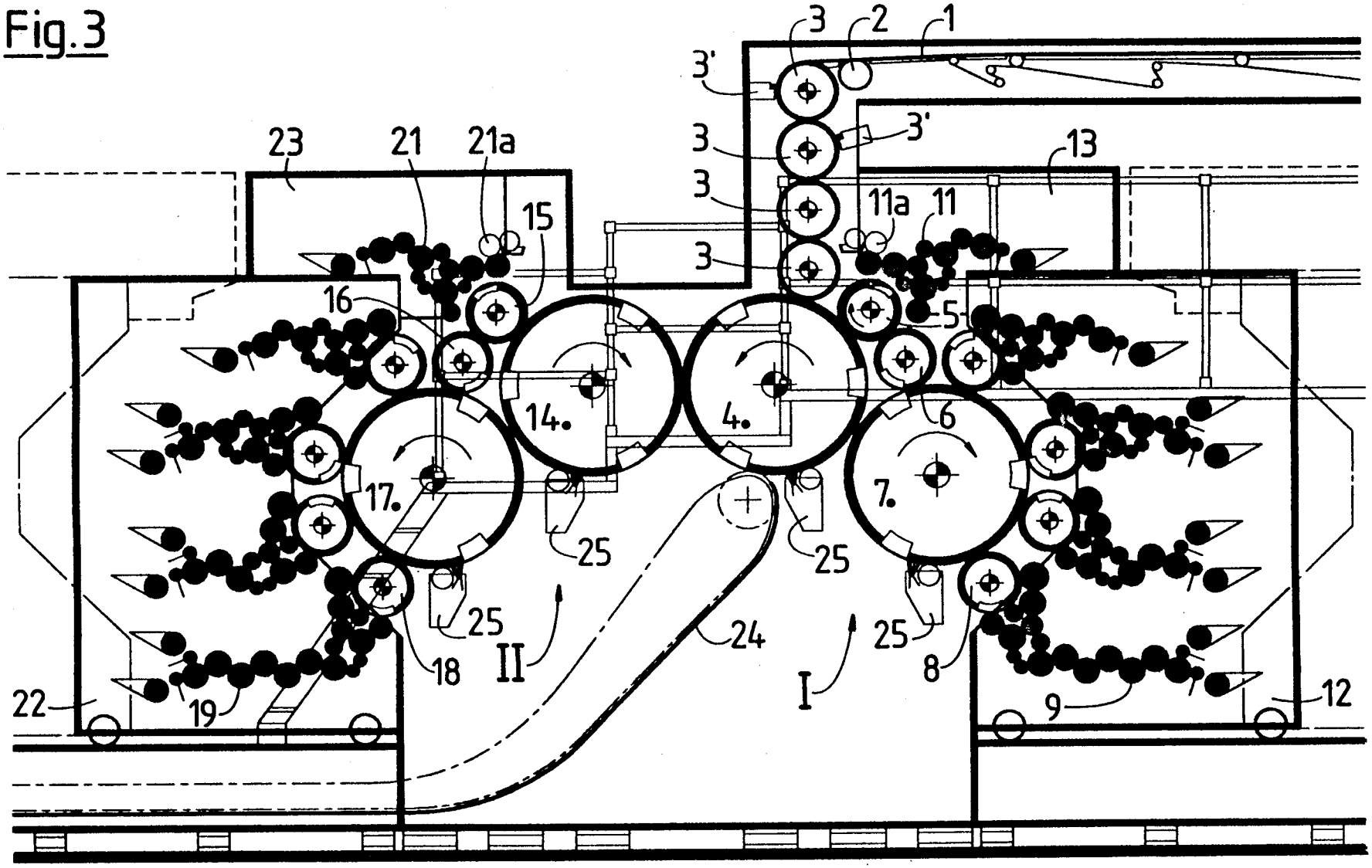
FIG. 3 shows a second embodiment of the printing machine according to the invention, in which the two printing units are in the collect-printing position.
Figure 4:
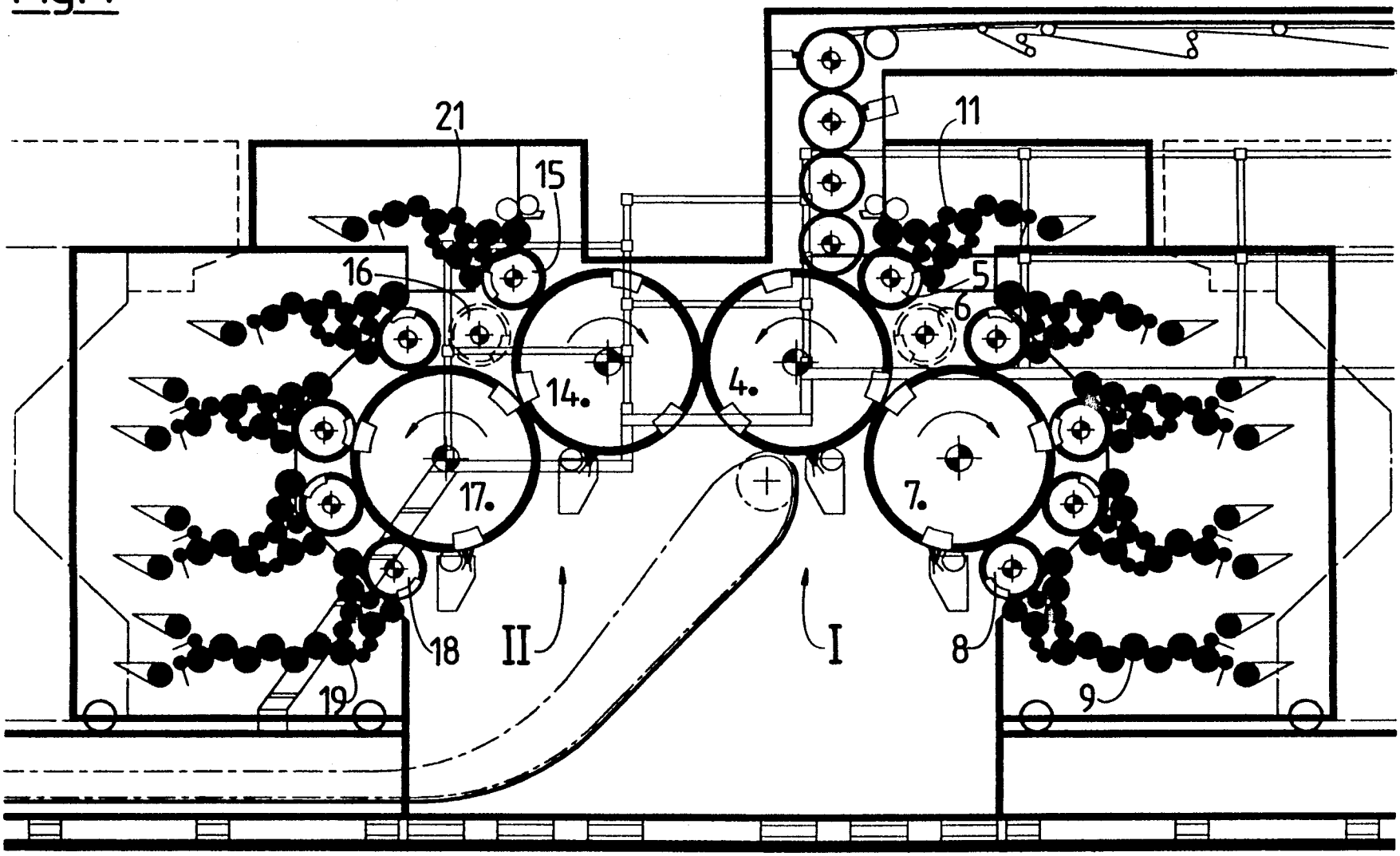
FIG. 4 shows the same machine with the two printing units in the offset-printing position.

In the example according to FIGS. 3 and 4, the image transfer cylinder 6, 16 interacts with the blanket cylinder 7, 17, and the plate cylinder 5, 15 rests against the blanket cylinder 4, 14 and can be inked by an inking unit 11, 21, although in collect printing the latter is separated from this plate cylinder 5, 15.

The blanket cylinders 4, 14 and 7, 17 are of the same size and have a diameter which is an integral multiple of, in the example under consideration three times, the diameter of the plate cylinders 5, 15 and 10, 20, of the image transfer cylinders 6, 16 and of the convertible cylinders 8, 18. The blanket cylinders 7 and 17 are lower than the blanket cylinders 4 and 14 and are respectively arranged offset obliquely outwards relative to these. Installed underneath each of the blanket cylinders 4, 14 and 7, 17 is an automatic blanket-washing device 25, by means of which the respective blankets can be washed when no printing takes place and which are, of course, moved away from these blanket cylinders during printing. Plate cylinders 5, 15 and image transfer cylinders 6, 16 are located above the blanket cylinders 7, 17, so that the space underneath the blanket cylinders 4, 14 and 7, 17 and between the inking-unit trolleys 12 and 22 is freely accessible.

The printing machine described can assume an offset-printing position and a collect-printing position. In the offset-printing position, the two blanket cylinders 4 and 7 in the printing unit I and the blanket cylinders 14 and 17 in the printing unit II are pressed against one another (FIG. 2 and FIG. 4), whereas in the collect-printing position they are moved away from one another (FIG. 1 and FIG. 3).

In the offset-printing position, the convertible cylinders 8 and 18 carry offset-printing plates, and the multi-color image with superposed colors, which is transferred from these offset plate cylinders onto the blanket cylinder 7, 17, is transferred directly onto the blanket cylinder 4, 14 and from there onto the paper.

In the exemplary embodiment according to FIG. 2, in the offset-printing position the plate cylinder 5, 15 is moved away both from the blanket cylinder 7, 17 and from the image transfer cylinder 6, 16 into an inoperative position. From the additional single-color printing unit, by means of the plate cylinder 10, 20 an additional single-color image is transferred via the image transfer cylinder 6, 16 onto the blanket cylinder 4, 14 and from this, together with the multi-color image coming from the blanket cylinder 7, 17, onto the paper.

In the exemplary embodiment according to FIG. 4, in the offset-printing position the image transfer cylinder 6, 16 is moved away into an inoperative position and the plate cylinder 5, 15 is the plate cylinder of an additional single-color wet offset-printing unit with the inking unit 11, 21 and with the dampening unit 11*a*, 21*a*. Thus, an additional single-color image is once again transferred onto the blanket cylinder 4, 14 and is printed, together with the multi-color image coming from the blanket cylinder 7, 17, onto the respective side of the paper.

In the collect-printing position, the plate cylinder 5 carries a collect-printing plate which has a complete printing design and which is preferably a typographic printing plate, and the convertible cylinders 8 and 18 carry color selector plates. These color selector plates have cutout reliefs corresponding to those regions of the collect-printing plate to be printed in a specific color and transfer a multi-color image with colors lying next to one another onto the blanket cylinder 7, 17 which functions as a color-collect cylinder and which itself inks the collect-printing plate on the plate cylinder 5, 15.

In the exemplary embodiment according to FIG. 1, in the collect-printing position the collect-printing plate cylinder 5 is inked directly by the blanket cylinder 4 and transfers the multi-color collect-printing image onto the blanket cylinder 4 via the image transfer cylinder 6. Moreover, the plate cylinder 10, 20 of the additional single-color printing unit applies an additional printing image via the image transfer cylinder 6, 16 onto the blanket cylinder 4, 14 and from this onto the paper.

In contrast, in the exemplary embodiment according to FIG. 3, the collect-printing plate cylinder 5, 15, which in this case is separated from its inking unit 11, 21 and from its dampening unit 11*a*, 21*a*, for example by setting aside the adjacent inking rollers or transfer rollers, is inked by the blanket cylinder 7 via the ink transfer cylinder 6, 16.

At least in the exemplary embodiment according to FIG. 3, the collect-printing plate carried by the plate cylinder 5 or 15 can also be a wet offset plate which is dampened by the then advanced dampening unit 11*a* or 21*a*.

Preferably, in the printing of banknotes by the printing machine described, both a multi-color safety background and a single-color main design are produced in one operation on each of the two sides.

In the example under consideration, there is a four-color safety background, produced in the offset-printing process by means of the respective four cylinders 8, 18 functioning as offset plate cylinders, or there is a four-color collect print produced by means of the respective collect-printing plate on the plate cylinder 5, 15 which receives its colors from the respective four cylinders 8, 18 functioning as color selector cylinders. The main design produced by the plate cylinder 10, 20 of the additional single-color printing unit is preferably a wet offset image which comes from a dampened intaglio printing plate and which, in particular, also has a further safety-background design completing and superposed on the multi-color safety background. The banknotes produced in this way have a especially high degree of safety against counterfeiting.

Of course, each of the two multi-color printing units I and II can work independently of the other according to the offset-printing process or according to the collect-printing process, so that the two banknote sides each receive a safety background produced by different printing process. Furthermore, it is possible, in principle, to provide on the free portions of the circumference of the blanket cylinders 4 and 14 at least one further printing unit, the plate cylinder of which interacts with the blanket cylinder 4, 14.

I claim:

1. A convertible multi-color printing machine for printing paper (1), especially banknotes, comprising:

two cooperating impression cylinders (4, 14) arranged and constructed to pass said paper (1) therebetween and to apply a multi-colored image on a respective side of said paper;

a plurality of inking units (9), each inking unit having a different color;

a plurality of convertible cylinders (8), each convertible cylinders being inked by a corresponding inking,unit (9);

converting means for converting said convertible cylinders (8) to one of color selecting cylinders and offset plate cylinders;

a blanket cylinder (7) having a periphery, with said convertible cylinders (8) being arranged around and in contact with said periphery;

blanket cylinder mounting means for selectively mounting said blanket cylinder into one of an offset printing position in which said blanket cylinder (7) contacts one of said impression cylinders (4), and a collect printing position in which blanket cylinder is spaced away from said impression cylinders (4, 14);

an image transfer cylinder (6) in contact with said one of said impression cylinders (4) for applying a multi-colored image thereon;

a collect plate cylinder (5) carrying a collect printing plate;

a collect plate mounting means for selectively mounting said collect plate cylinder to an operative position and an inoperative position, in said operative position said collect plate cylinder being in contact with said blanket cylinder (7) so that the collect printing plate is inked by said blanket cylinder (7) in said collect printing position, and with said image transfer cylinder for picking up said multi-colored image; and an additional single-color printing unit having an additional plate cylinder (10) with a single color image and an additional inking unit (11), said additional single-color printing unit being in contact with said image transfer cylinder (6) for transferring said single color image thereto.

2. A convertible multi-color printing machine as claimed in claim 1, wherein the additional single-color printing unit is a dry offset-printing unit.

3. The convertible multi-color printing machine as claimed in claim 1, wherein the additional single.color printing unit is a wet offset-printing unit and further comprising an intaglio printing plate working with said additional single color printing unit and a damping unit (11*a*) for damping said intaglio printing plate.

4. A convertible multi-color printing machine as claimed in claim 1, wherein, in the collect-printing position, the collect-printing plate is one of a dry offset plate and a wet offset plate dampened by a dampening unit.

5. A convertible multi-color printing machine as claimed in claim 1, further comprising removable automatic blanket-washing devices (25) for the blanket and impression cylinders (4, 14, 7, 17).

6. A convertible printing machine as claimed in claim 1, wherein one of said offset plate cylinders and the collect printing plate have a respective multi-color printing design for multi-color a safety background, and the additional plate cylinder has a main design.

7. A printing machine of claim 6 wherein said additional plate cylinder has an additional safety-background design to be superposed on the multi-color safety background.

8. A convertible multi-color printing machine for printing paper (1), especially banknotes, comprising:

two cooperating impression cylinders (4, 14) arranged and constructed to pass said paper (1) therebetween and to apply a multi-colored image on a respective side of said paper;

a first and second group of inking units (9, 19) of different colors;

a first and a second group of convertible cylinders (8, 18), each convertible cylinders being inked by a corresponding inking unit (9, 19) of said group of inking units;

converting means for converting said convertible cylinders (8, 18) to one of color selecting cylinders and offset plate cylinders;

two blanket cylinders (7, 17) each having a periphery, with said convertible cylinders (8, 18) being arranged around and in contact with the periphery of one of said cylinders (7, 17);

blanket cylinders mounting means for selectively mounting said blanket cylinders (7, 17) into one of an offset printing position in which each of said blanket cylinders (7, 17) contact one of said impression cylinders (4, 14), and a collect printing position in which blanket cylinder (7, 17) are spaced away from said impression cylinders (4, 14);

two image transfer cylinders (6, 16), each being in contact with one of said impression cylinders (4, 14) for applying a multi-colored image thereon;

two collect plate cylinders (5, 15) each carrying a collect printing plate;

collect plate mounting means for selectively mounting said collect plate cylinders (5, 15) to an operative position and an inoperative position in said operative position each of said collect plate cylinders being in contact with one of said blanket cylinders (7, 17) so that the respective collect printing plate is inked by one of said blanket cylinders (7, 17) in said collect printing position, and with of one said image transfer cylinders (6, 16) for picking up said multi-colored image; and two additional single-color printing units, each having an additional plate cylinder (10, 20) with a single color image and an additional inking unit (11, 21), each said additional single-color printing unit being in contact with one of said image transfer cylinders (6, 16) for transferring said single color image thereto.

9. A convertible multi-color printing machine as claimed in claim 8, wherein said impression and blanket cylinders (4, 14, 7, 17) are of the same size and have a diameter which is an integral multiple of the diameter of the collect plate and additional plate cylinders (5, 15, 10, 20), of the image transfer cylinders (6, 16) and of the convertible cylinders (8, 18); wherein the two blanket cylinders (7, 17) are lower than the two impression cylinders (4, 14) and are respectively arranged offset obliquely outwards; and wherein the collect plate cylinders (5, 15) and the image transfer cylinders (6, 16) are located above the blanket cylinders (7, 17) and the undersides of the impression cylinders (4, 14) is free of offset plate cylinders and of color selecting cylinders.

10. A printing machine of claim 9 wherein said impression and blanket cylinders (4, 14, 7, 17) have a diameter three times larger than the diameter of said collect plate cylinders (5, 15).

* * * * *